US006536391B2

(12) United States Patent
Kunz

(10) Patent No.: US 6,536,391 B2
(45) Date of Patent: Mar. 25, 2003

(54) COMPACT HYDRAULIC LASH ADJUSTER

(75) Inventor: Timothy W. Kunz, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/976,487

(22) Filed: Oct. 12, 2001

(65) Prior Publication Data

US 2002/0069846 A1 Jun. 13, 2002

Related U.S. Application Data

(60) Provisional application No. 60/255,512, filed on Dec. 13, 2000.

(51) Int. Cl.[7] ..... F01P 3/00

(52) U.S. Cl. ..... 123/90.43; 123/90.46; 123/90.55; 123/90.57

(58) Field of Search ..... 123/90.43, 90.46, 123/90.55, 90.57

(56) References Cited

U.S. PATENT DOCUMENTS

| | | | | | |
|---|---|---|---|---|---|
| 4,762,096 | A | * | 8/1988 | Kamm et al. | 123/90.16 |
| 5,311,845 | A | * | 5/1994 | Takahashi | 123/90.43 |
| 5,706,771 | A | | 1/1998 | Van Heyningen et al. | |
| 6,021,751 | A | | 2/2000 | Spath | |
| 6,039,017 | A | | 3/2000 | Hendriksma | |
| 6,273,039 | B1 | * | 8/2001 | Church | 123/90.16 |
| 6,325,034 | B1 | | 12/2001 | Edelmayer | |

* cited by examiner

*Primary Examiner*—Thomas Denion
*Assistant Examiner*—Ching Chang
(74) *Attorney, Agent, or Firm*—Patrick M. Griffin

(57) ABSTRACT

A hydraulic lash adjuster includes a leak down land and a support land that are substantially cylindrical. The support land is substantially coaxial relative to the leak down land, and at least a portion of the support land is disposed radially opposite the leak down land.

15 Claims, 3 Drawing Sheets

COMPACT HYDRAULIC LASH ADJUSTER

CROSS REFERENCE TO RELATED APPLICATIONS

This application claims the benefit of U.S. Provisional Patent Application Serial No. 60/255,512, filed Dec. 13, 2000.

TECHNICAL FIELD

The present invention relates to hydraulic lash adjusters for taking up lash in engine valve trains.

BACKGROUND OF THE INVENTION

Hydraulic lash adjusters form pivots for cam finger followers, and compensate for dimensional changes in the valve train system of an engine thereby reducing or eliminating the need for mechanical and/or manual adjustment of the valve train. One example of a conventional hydraulic lash adjuster is described and shown in commonly-assigned U.S. Pat. No. 6,039,017 (Hendriksma), the disclosure of which is incorporated herein by reference.

More particularly, conventional hydraulic lash adjusters include a cup-shaped body having a closed end and an open end. A plunger having a closed bottom and an open top is reciprocably disposed within the body such that the closed bottom of the plunger is proximate the closed end of the body. A high-pressure chamber is defined between the closed end of the body and the bottom of the plunger. A piston having an open end and a closed end is also reciprocably disposed within the body. The open end of the piston engages the open top of the plunger during valve opening, and is otherwise spaced a predetermined distance from the plunger. A low-pressure chamber is defined between the plunger and the closed end of the piston. The plunger bottom defines an orifice that extends between the low-pressure chamber and the high-pressure chamber. A check valve associated with the orifice in the plunger controls the flow of fluid between the two chambers. A cam finger follower engages and pivots about the piston body, and exerts thereon a downward force tending to displace the piston in a downward direction relative to the body.

A leak down land is defined by a tight tolerance fit or interface between the outer surface of the plunger and the inner surface of the body. The leak down land provides a path for the flow of oil that is displaced from the high-pressure chamber by the increase in pressure therein due to the force applied to the piston by the associated finger cam follower during a valve opening event. The displaced oil "leaks down" into the low-pressure chamber. A support land is defined by the interface between the body and the piston, and as such is coaxial with and axially separated from the leak down land. The support land is necessary to provide a support surface for loads, especially side loads, imposed upon the lash adjuster by the valve train during engine operation.

Space in modern engines is at a premium, and manufacturers are continually striving to reduce the size and weight of component parts, such as hydraulic lash adjusters. Therefore, engine manufacturers are requesting more compact, i.e., smaller and lighter, hydraulic lash adjusters. However, as the size and weight of hydraulic lash adjusters are reduced corresponding degradations in performance and durability are incurred. Such degradations in performance can include a decrease in the load carrying capacity of smaller hydraulic lash adjusters. A reduction in the load carrying capacity of a hydraulic lash adjuster reduces the overall performance of the valve train system.

Therefore, what is needed in the art is a compact hydraulic lash adjuster that has a load carrying capacity that is comparable to the load carrying capacity of conventional/larger hydraulic lash adjusters.

Furthermore, what is needed in the art is a hydraulic lash adjuster that reduces or substantially eliminates the axial separation of the support land and the leak down land.

SUMMARY OF THE INVENTION

The present invention provides a compact lash adjuster for taking up lash in engine valve trains.

The invention comprises, in one form thereof, a leak down land and a support land that are substantially cylindrical. The support land is substantially coaxial relative to the leak down land, and at least a portion of the support land is disposed radially opposite the leak down land.

An advantage of the present invention is the lash adjuster is substantially more compact in height or axial dimension than conventional lash adjusters without substantially reducing load carrying capacity.

Another advantage of the present invention is that the support land and leak down land are at least partially radially opposite each other, thereby making the lash adjuster more compact.

BRIEF DESCRIPTION OF THE DRAWINGS

The above-mentioned and other features and advantages of this invention, and the manner of attaining them, will become apparent and be better understood by reference to the following description of the invention in conjunction with the accompanying drawings, wherein.

Corresponding reference characters indicate corresponding parts throughout the several views. The exemplifications set out herein illustrate the preferred embodiments of the invention and such exemplifications are not to be construed as limiting the scope of the invention in any manner.

DESCRIPTION OF THE PREFERRED EMBODIMENTS

Figure 1:
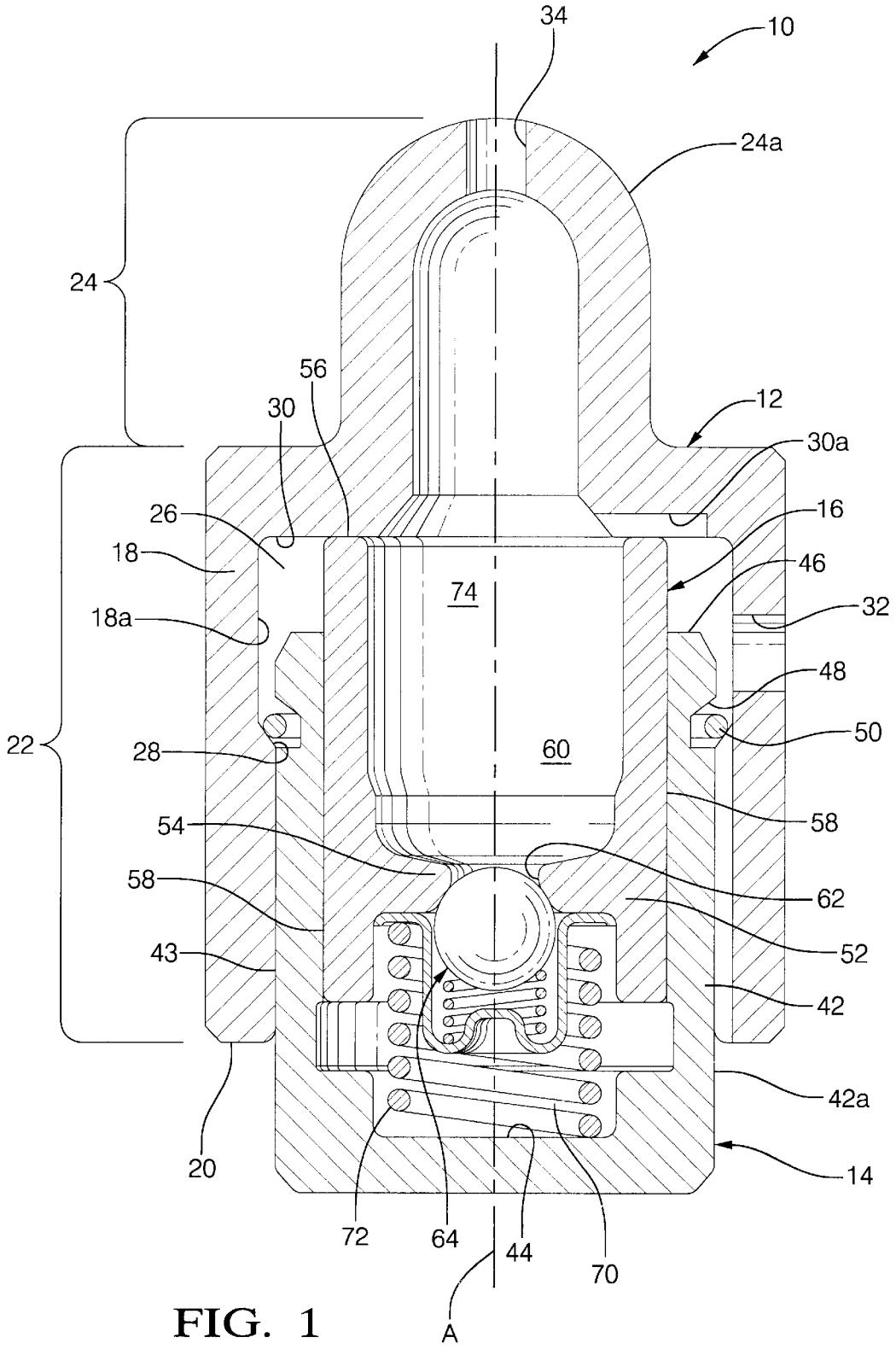
FIG. 1 is a cross-sectional view of one embodiment of a compact hydraulic lash adjuster of the present invention operably installed in an engine.

Referring now to the drawings, and particularly to FIG. 1, there is shown one embodiment of a compact hydraulic lash adjuster (CHLA) of the present invention. CHLA 10 includes outer body 12, inner body 14 and plunger 16.

Outer body 12 includes side wall 18 and open end 20. Side wall 18 defines housing portion 22 and rocker arm support portion 24 of outer body 12. Each of housing portion 22 and rocker arm support portion 24 is substantially cylindrical, having a common central axis A. Housing portion 22 defines cylinder 26 having an inner wall formed by inside surface 18*a* of side wall 18. Cylinder 26 is adjacent to or contiguous with open end 20 of outer body 12. Inside surface 18*a* defines a circumferentially-disposed chamfered rim or ledge 28 within cylinder 26. Inside surface 18*a* also defines surface 30 at the end of cylinder 26 that is opposite open end 20 thereof. Surface 30, in turn, defines at least one radiallydirected channel or slot 30*a* (only one shown), the purpose of which is more particularity described hereinafter. Side wall 18 further defines a radially-disposed feed orifice 32 therethrough and into cylinder 26, and an axially-disposed orifice 34 through support portion 24. Rocker arm support portion 24 includes a convex or semi-spherical rocker arm engaging surface 24*a*.

Inner body 14 includes side wall 42, bottom 44 and open end 46. Inner body 14 is a cup-shaped member that is received at least partially within and is substantially coaxial with cylinder 26 of outer body 12. Standard or typical manufacturing tolerances or clearances exist between outer surface 42*a* of side wall 42 and inside surface 18*a* of side wall 18. For example, the clearance between inside surface 18*a* of side wall 18 and outside surface 42*a* of side wall 42 is from approximately 5 to approximately 50 microns. Support land 43 is formed by the interface of inside surface 18*a* of side wall 18 with the outside surface 42*a* of side wall 42, and extends from approximately open end 20 of outer body 12 to approximately ledge 28 of outer body 12. Support land 43 provides support for the loads, especially the side loads, imposed upon CHLA 10 by the associated valve train. Outer surface 42*a* defines circumferential recess 48 proximate open end 46. Retaining ring 50 is disposed partially within recess 48 and engages the chamfered rim or ledge 28 that is disposed on the inside surface 18*a* of side wall 18, thereby limiting the axial displacement of inner body 14 relative to outer body 12 in a downward direction.

Plunger 16 includes substantially cylindrical plunger wall 52, plunger bottom 54 and open plunger end 56. Plunger 16 is received partially within inner body 14 such that plunger 16 is substantially coaxial with inner body 14 and such that a portion of plunger wall 52 extends from inner body 14 in the direction of surface 30 of outer body 12. Leak down path or land 58 is defined by a very tight tolerance/clearance, such as, for example, from approximately 2 to approximately 10 microns, between the outside surface (not referenced) of plunger wall 52 and the inside surface (not referenced) of inner body 14. Leak down land 58 extends from approximately the open end (not referenced) of inner body 14 to the end (not referenced) of side wall 52 disposed opposite open end 56 of plunger 16. Plunger wall 52 and plunger bottom 54 conjunctively define plunger cavity 60. Plunger bottom 54 defines plunger orifice 62 therethrough that is substantially concentric with central axis A. Fluid control valve 64, such as, for example, a check valve, is associated with plunger orifice 62. Open to plunger end 56 is in abutting engagement with surface 30 of outer body 12, except for the clearance defined between open plunger end 56 and surface 30 by slot 30*a*.

High pressure chamber 70 is defined between plunger bottom 54 and bottom 44 of inner body 14. Plunger spring 72 is disposed within high pressure chamber 70, and engages each of plunger bottom 54 and bottom 44 of inner body 14. Low pressure chamber 74 is defined by cavity 60 of plunger 16, the area enclosed by the portion of side wall 18 that forms rocker arm support portion 24, and the are of cylinder 26 outside of plunger cavity 60 and above retaining ring 50.

It should be particularly noted that leak down land 58 and support land 43 are, as described above, formed by interfacing surfaces that are substantially cylindrical in shape, have different diameters, and are substantially coaxial relative to each other. Thus, leak down land 58 and support land 43 are substantially coaxial relative to each other. A common or shared axially-extending segment of side wall 42 separates leak down land 58 and support land 43 from each other in a radial direction. The portions of leak down land 58 and support land 43 separated from each other by side wall 42 are disposed opposite each other in a radial direction. In other words, at least a portion of support land 43 is disposed inside of, i.e., radially opposite to, leak down land 58.

In contrast, the leak down land and support land of a conventional hydraulic lash adjuster are not radially separated by a common or shared wall, nor is any portion of the leak down land radially opposite the support land. With support land 43 and leak down land 58 being disposed coaxially relative to, radially separated and/or opposite from, and axially overlapping each other, the overall height of CHLA 10 is substantially reduced relative to a conventional hydraulic lash adjuster. Further, little or substantially no increase in the diameter of CHLA 10 results. Thus, CHLA 10 is substantially more compact than, and yet retains substantially the same performance, durablity and load carrying capacity of, a conventional hydraulic lash adjuster.

Figure 2:
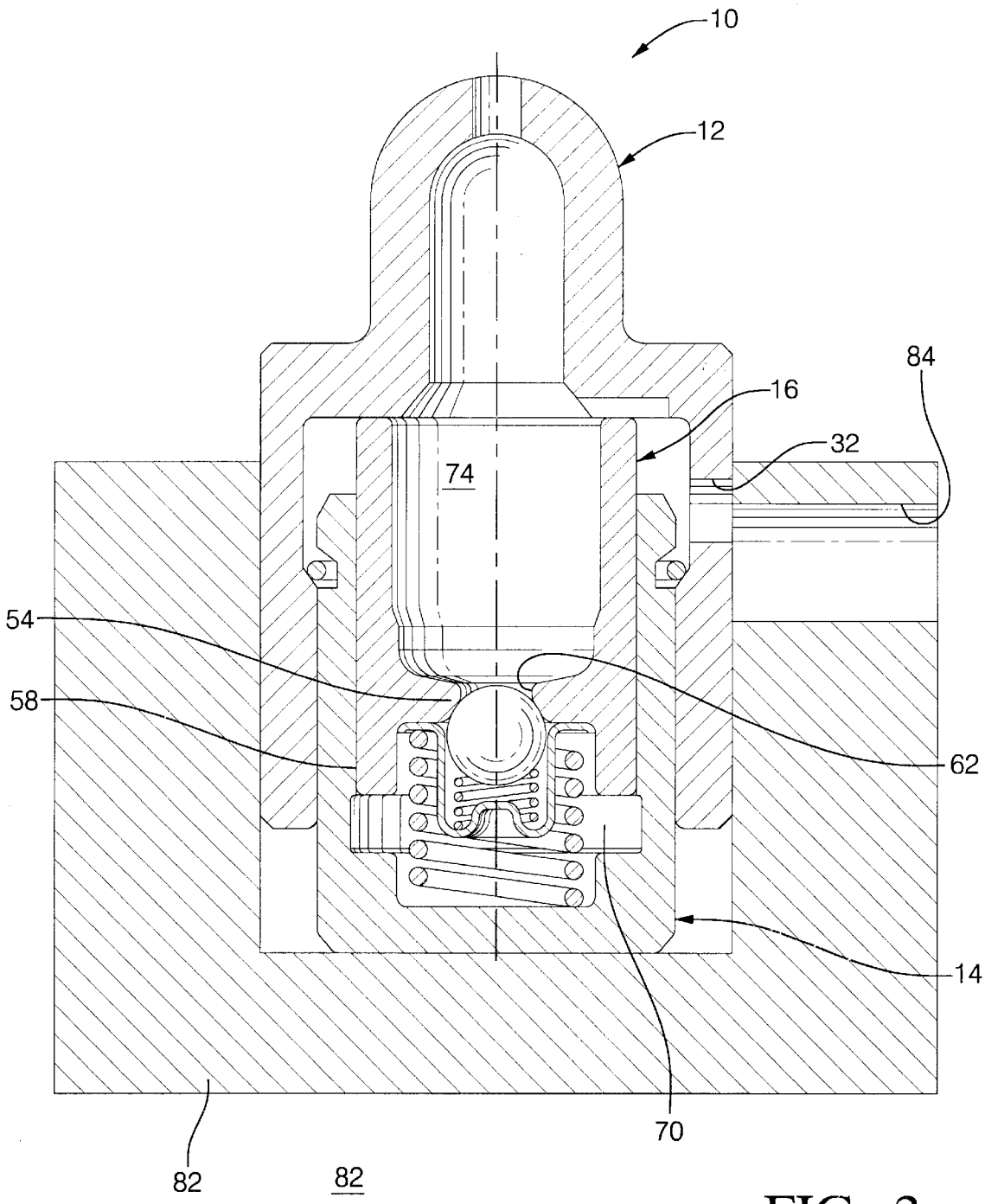
FIG. 2 is a cross-sectional view of the compact hydraulic lash adjuster of FIG. 1 operably installed in an engine.

In use, as best shown in FIG. 2, CHLA 10 is operably installed within the valvetrain (not shown) of engine 80. More particularly, CHLA 10 is mounted in the cylinder head 82 of engine 80 such that oil gallery 84 in head 82 is in fluid communication with feed orifice 32 of outer body 12. Oil in oil gallery 84 flows under engine oil pressure through feed orifice 32 and into low pressure chamber 74. The oil is forced through plunger orifice 62 in plunger bottom 54, and into high pressure chamber 70. Thus, low pressure chamber 74 and high pressure chamber 70 are both initially filled with oil at engine oil pressure.

When the engine valve (not shown) associated with CHLA 10 is opened, a downward force is exerted upon CHLA 10. More particularly, a downward force is applied to rocker arm support surface 24*a*, and thus to rocker arm support portion 24 and outer body 12. The downward force displaces outer body 12 in a generally downward direction relative to inner body 14, i.e., open end 20 of outer body 12 moves in the direction of bottom 44 of inner body 14. Any side loads, i.e., components of the downward force in a non-axial direction, that are applied to rocker arm support surface 24*a*, and thus outer body 12, are absorbed and counteracted by support land 43. The downward displacement of outer body 12 relative to inner body 14, in turn, displaces plunger 16 in a downward direction relative to inner body 14. The downward displacement of plunger 16 compresses the oil within high pressure chamber 70 and causes fluid control valve 64 to seal plunger orifice 62. Control valve 64, by sealing plunger orifice 62, prevents the pressurized oil in high pressure chamber 70 from escaping through plunger orifice 62. Continued downward displacement of outer body 12 and plunger 16 relative to inner body 14 increases the pressure of the oil contained within high pressure chamber 70. The compressed oil supports plunger 16 and outer body 12 thereby providing the needed reaction pivot required for the associated finger follower and the opening of the associated valve.

During the valve-opening event, the pressure in high pressure chamber 70 is substantially increased by the downward displacement of body 12 and plunger 16, and thus provides the reaction force to support the load imposed by the valve train. Since oil cannot escape from high pressure chamber 70 through plunger orifice 62, which is sealed by fluid control valve 64, a certain amount of oil is forced through leak down land 58 and into low pressure chamber 74 and/or the portion of cylinder 26 above ledge 28. The amount of oil that flows through leak down land 58 is controlled by the size of leak down land 58, i.e., the clearance between the inner surface (not referenced) of inner body 14 and the outer surface (not referenced) of plunger 16.

When the valve associated with CHLA 10 is again closed, the force applied by the valve train (i.e., the valve spring of the associated valve) upon outer body 12 via rocker arm support portion 24 is removed. Plunger spring 72 biases plunger 16 and, thus, outer body 12 in an upward direction causing the pressure within high pressure chamber 70 to decrease and allowing fluid control valve 64 to open. With fluid control is valve 64 open, oil is once again free to flow from the low pressure chamber 74 into the high pressure chamber 70 and thereby replace or makeup for the oil displaced from high pressure chamber 70 during the prior valve opening event. The flow of this makeup oil continues during the time that the finger follower is on the base circle of the associated cam until all of the lash created in the valve train by the forcing of oil from the high pressure chamber 70 is removed.

Figure 3:
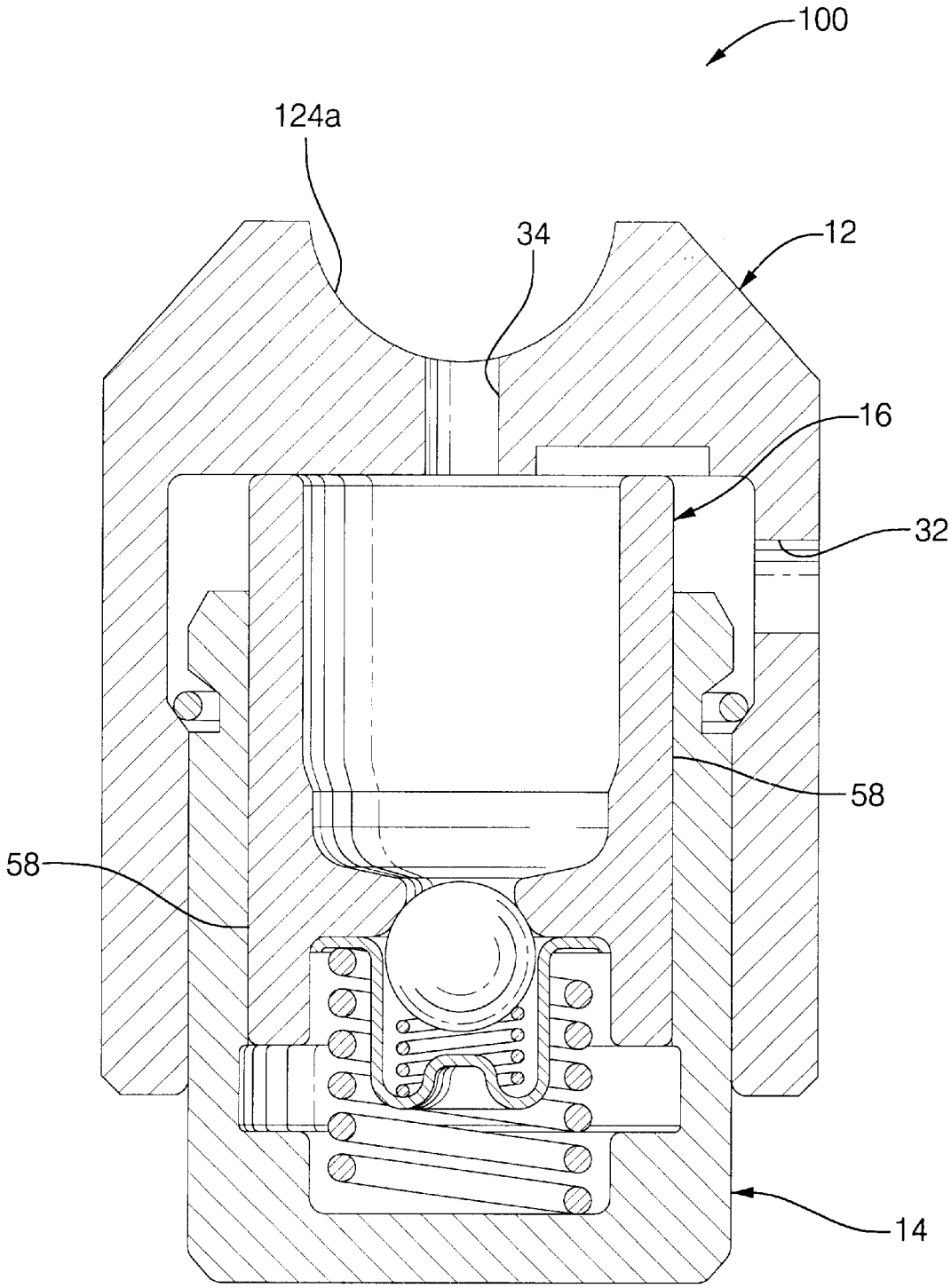
FIG. 3 is a cross-sectional view of a second embodiment of a compact hydraulic lash adjuster of the present invention.

Referring now to FIG. 3, a second embodiment of a compact hydraulic lash adjuster (CHLA) of the present invention is shown. Whereas CHLA 10 is configured with a convex and semi-spherical rocker arm engaging surface 24*a*, CHLA 100 is configured with a concave semi-spherical rocker arm engaging surface 124*a*. The remainder of the design, construction and operation of CHLA 100 is substantially similar to CHLA 10.

In the embodiment shown, CHLA 10 includes orifice 32, which provides a passageway for the flow of oil into low pressure chamber 74. However, it is to be understood that the present invention can be alternately configured, such as, for example, with an outer body having a flat or notch 36 (FIG. 1) defined on the inner surface thereof that defines the passageway for the flow of oil into the low pressure chamber.

In the embodiment shown, CHLA 10 includes slot 30*a* on surface 30 of outer body 12, which serves as a passageway for the flow of oil into low pressure chamber 74. However, it is to be understood that the present invention can be alternately configured, such as, for example, with a plunger body having an orifice or notch that defines the passageway for the flow of oil into low pressure chamber 74.

While this invention has been described as having a preferred design, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

What is claimed:

1. A hydraulic lash adjuster, comprising:

a substantially cylindrical outer body having a side wall, an open end and a closed end, said side wall interconnecting said open end and said closed end, one of a flat and a notch defined by said side wall and extending from said open end a predetermined distance toward said closed end, a groove defined by said closed end, said groove in fluid communication with said one of said flat and said notch;

a substantially cylindrical inner body having a side wall, an open end and a closed end, said side wall interconnecting said open end and said closed end, said open end of said inner body being disposed within said outer body to thereby dispose at least a portion of said inner body within said outer body;

a substantially cylindrical plunger body having a plunger wall, an open plunger end and a plunger bottom, said plunger wall interconnecting said open plunger end and said plunger bottom, said plunger bottom defining a plunger orifice therethrough, said plunger bottom being disposed within said inner body to thereby dispose at least a portion of said plunger body within said inner body;

a high pressure chamber defined between said plunger bottom, said closed end of said inner body, and said side wall of said inner body; and a low pressure chamber defined between said plunger bottom, said side wall of said plunger, and said closed end and said side wall of said outer body, said low pressure chamber in fluid communication with said slot and said one of said flat and said notch.

2. The hydraulic lash adjuster of claim 1, further comprising a leak down land defined between an outer surface of said plunger wall and an inner surface of said side wall of said inner body.

3. The hydraulic lash adjuster of claim 2, further comprising a support land defined between an inner surface of said side wall of said outer body and an outer surface of said side wall of said inner body.

4. The hydraulic lash adjuster of claim 3, wherein said leak down land and said support land are substantially coaxial relative to each other, at least a portion of said leak down land being radially opposite said support land.

5. The hydraulic lash adjuster of claim 3, further comprising a fluid control valve disposed in association with said plunger orifice.

6. A hydraulic lash adjuster, comprising:

a substantially cylindrical outer body having a side wall, an open end and a closed end, said side wall interconnecting said open end and said closed end said, said outer body having an inner surface, a circumferential ledge defined by said inner surface;

a substantially cylindrical inner body having a side wall, an open end and a closed end, said side wall interconnecting said open end and said closed end, said inner body having an outer surface, a circumferential recess defined by said outer surface, said open end of said inner body being disposed within said outer body to thereby dispose at least a portion of said inner body within said outer body;

a substantially cylindrical plunger body having a plunger wall, an open plunger end and a plunger bottom, said plunger wall interconnecting said open plunger end and said plunger bottom, said plunger bottom defining a plunger orifice therethrough, said plunger bottom being disposed within said inner body to thereby dispose at least a portion of said plunger body within said inner body;

a high pressure chamber defined between said plunger bottom, said closed end of said inner body, and said side wall of said outer body;

a low pressure chamber defined between said plunger bottom, said side wall of said plunger and said side wall of said outer body;

a support land defined between an inner surface of said side wall of said outer body and an outer surface of said side wall of said inner body; and a retaining ring disposed at least partially within each of said ledge and said recess to thereby couple together said outer body and said inner body.

7. The hydraulic lash adjuster of claim 3, further comprising an oil inlet means, said oil inlet means providing a passageway for the flow of oil into said low pressure chamber.

8. The hydraulic lash adjuster of claim 7, wherein said oil inlet means comprises an orifice defined by and through said side wall of said outer body.

9. The hydraulic lash adjuster of claim 7, further comprising oil outlet means, said oil outlet means providing a passageway for the flow of oil out of said low pressure chamber.

10. The hydraulic lash adjuster of claim 9, wherein said oil outlet means comprises an orifice defined by and through said side wall of said outer body.

11. The hydraulic lash adjuster of claim 3, further comprising a plunger spring disposed within said high pressure chamber and biasing said plunger and said inner body axially apart.

12. A hydraulic lash adjuster, comprising:

an outer body defining a cylinder, said outer body having an open end, a closed end, and an inner surface, one of a flat and notch defined by said inner surface, a groove defined by said closed end, said one of a flat and notch extending from said open end to said groove;

a substantially cylindrical inner body disposed at least partially within and substantially coaxial relative to said cylinder;

a substantially cylindrical plunger body disposed at least partially within and substantially coaxial relative to said inner body;

a support land defined by an interface between an outer surface of at least a first portion of said inner body and a radially opposite inner surface of said outer body; and a leak down land defined between an inner surface of at least a second portion of said inner body and a radially opposite outer surface of said plunger body;

an inlet fluid path defined between an outer surface of said inner body and said one of said flat and notch defined by said inner surface of said outer body and said groove defined by said closed end of said outer body.

13. The hydraulic lash adjuster of claim 12, wherein said leak down land and said support land are substantially coaxial relative to each other.

14. The hydraulic lash adjuster of claim 12, wherein said first portion of said inner body and said second portion of said inner body partially overlap.

15. The hydraulic lash adjuster of claim 12, wherein said first portion of said inner body and said second portion of said inner body substantially overlap.

* * * * *